United States Patent [19]

Faltin

[11] 4,424,965

[45] Jan. 10, 1984

[54] HIGH SPEED TRANSPORT SYSTEM FOR NEWSPAPERS AND THE LIKE

[75] Inventor: Hans G. Faltin, York, Pa.

[73] Assignee: Advance Enterprises, Inc., York, Pa.

[21] Appl. No.: 271,032

[22] Filed: Jun. 4, 1981

[51] Int. Cl.[3] ..... B65H 29/66

[52] U.S. Cl. ..... 271/202; 271/204

[58] Field of Search ..... 271/277, 151, 204, 205, 271/206, 202, 185

[56] References Cited

U.S. PATENT DOCUMENTS

| | | | |
|---|---|---|---|
| 3,671,035 | 6/1972 | Reist | 271/204 X |
| 3,955,667 | 5/1976 | Müller | 198/180 |
| 4,201,286 | 5/1980 | Meier | 271/277 X |
| 4,320,894 | 3/1982 | Reist | 271/277 |
| 4,333,559 | 6/1982 | Reist | 271/277 X |

*Primary Examiner*—Richard A. Schacher

*Attorney, Agent, or Firm*—Laurence R. Brown

[57] ABSTRACT

Paper sheet products are conveyed in shingled array at speeds up to 60,000 pieces per hour in the grasp of individual normally closed clamps precisely spaced on a chain link drive and timed for on-line processing at various stations. Thus, clamp tractor units have wheels mating with a U-channel track and rolling at low friction along the track, which may be bent and twisted to conform to a desired pathway in a plant between processing stations. Entrance and exit stations along the transit path provide mating cam surfaces at the station and on the clamp for opening the clamps to receive the products or to discharge them on further processing or transit equipment. Simplified equipment with more reliable pickup and release controls assuring individual product timing and positioning is accomplished by spring biased jaws pivotable by simple cams into open product receiving and closed product gripping and registration positions.

7 Claims, 10 Drawing Figures

FIG. 3
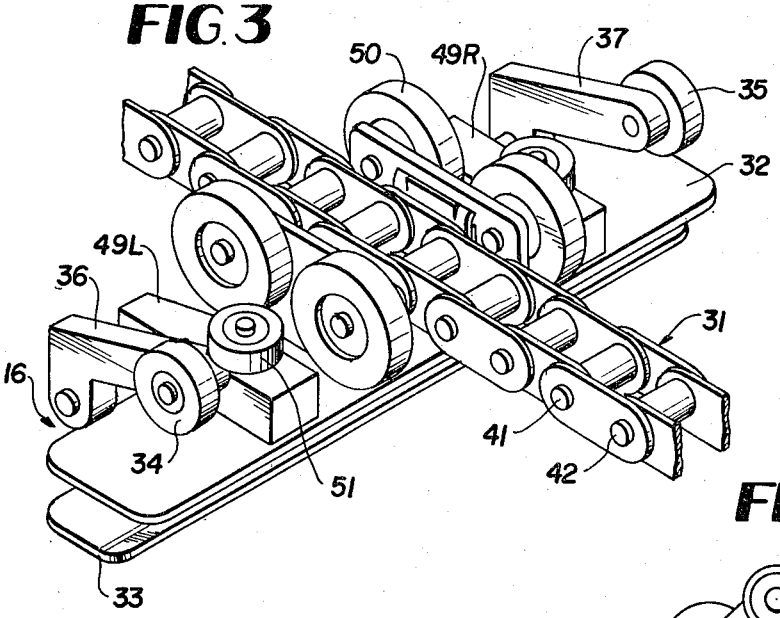
FIG. 3A
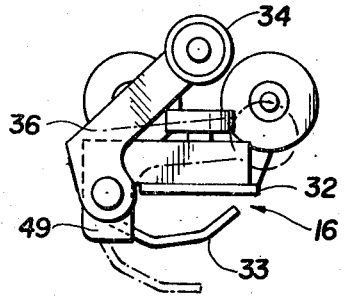
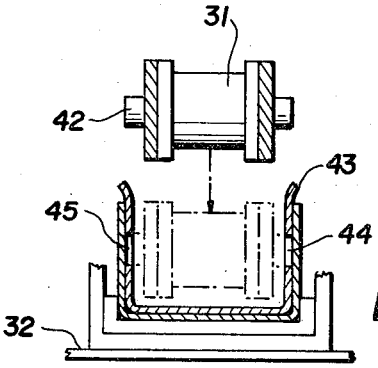
FIG. 4A
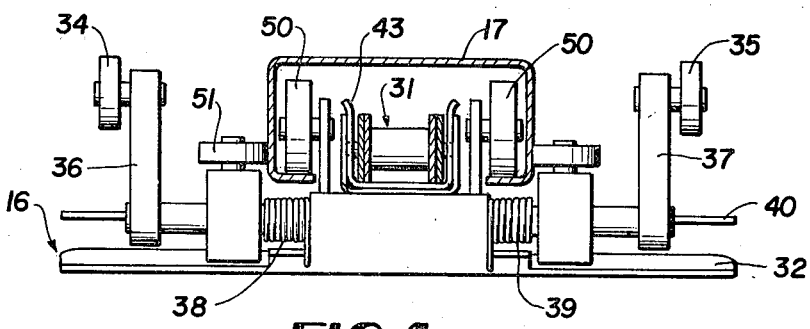
FIG. 4

HIGH SPEED TRANSPORT SYSTEM FOR NEWSPAPERS AND THE LIKE

TECHNICAL FIELD

This invention relates to transport systems for carrying newspapers, inserts and the like along transport paths between processing stations and more particularly it relates to precision high speed transport systems capable of transporting papers on-line from presses operating at speeds in the order of 60,000 individual pieces per hour at precisely spaced and timed intervals for direct synchronous input into on-line processing stations for inserting, stitching, counting, addressing, etc. BACKGROUND ART Because of the variation of weight of newspapers and like paper sheet products of few and many pages and the considerable extent of inertia involved in changing the location or speed of such papers, prior art transit systems have involved complex, sensitive, costly and low speed equipment. This has necessitated off-line processing at stitching, inserting, addressing, counting, bundling and like processing stations with the corresponding necessity to retime and space the paper products for the characteristics of the particular processor. Further, the problem of transport of papers from a high speed press producing in the order of 60,000 individual pieces per hour with simple equipment compatible in timing and positioning with input equipment subsequent processing stations has been unresolved.

Thus, it is one objective of this invention to provide improved high speed on-line transport systems, which will precisely control timing and spacing of individual paper products for further processing at desired work stations.

Typical prior art transport systems use movable belts, spring or other types of conveyors. However, the newspapers moving at high speeds are jiggled, vibrated and moved enough to destroy the precise spacing and timing necessary to synchronously enter on-line processing equipment. The problem is even worse when the transport system needs take curved paths where centrifugal and centripetal forces also tend to dislocate the papers when speeds are high. Thus, straight line conveyor belt systems are bulky and awkward taking up much space and significantly limiting the flexibility of location of presses, processing stations, etc.

Therefore, another object of this invention is to produce a compact precision high speed transport system that is substantially unlimited in configuration and curvature over the transit path.

Ease of access, maintenance and repair in the critical delivery time context of the newspaper industry is also essential in a transport system.

Therefore, a further objective is to provide equipment that is readily and simply maintained.

System cost and operating cost is also a very important factor in high speed transport equipment. Cost and complexity is expected to be high if speed and precision is improved. However, an object of this invention is to provide the unobvious and unexpected result of simpler, more inexpensive equipment with superior performance.

Typical prior art transport and processing equipment is exemplified in my U.S. Pat. No. 4,138,101 issued Feb. 6, 1979 for High Speed Insert Handling Mechanism and Method.

DISCLOSURE OF THE INVENTION

A system for on-line transport and processing of newspapers and like paper sheet products in shingled array at speeds up to 60,000 pieces per hour is provided. Each product is individually gripped by a normally closed clamp removably affixed to a chain link drive at precisely spaced locations for exactly timing the arrival of the product so that on-line processing can occur at synchronously actuated processing stations such as stitchers, inserters, addressers, etc.

The transit path may be curved and twisted over a desired transit path by means of conforming the shape of a U-shaped channel track in which the clamp rolls on mating low friction rollers.

Products are received and released at entrance-exit stations where mating cam surfaces on the clamp and transit path open the normally closed clamps. For selective removal, the cam surfaces may be programmed for mating upon command at any desired station, such as for on-line detour through an addressing station only when addressed papers are to be produced.

The transmit track is modularized over long transit distances to keep the friction and drive power within reasonable ranges by releasing products from one modular unit onto a conveyor belt interchange unit feeding a succeeding transport module.

Other features, objects and advantages of the invention will be found througout the following description, drawings and claims.

BRIEF DESCRIPTION OF DRAWINGS

FIG. 3 is a perspective view of a clamp assembly afforded by this invention with a portion of the coupled bowchain drive;

FIG. 3A is an end view of the clamp showing the pivoting cam assembly with the fully opened clamp position shown in phantom view;

FIG. 4 is an elevation view of a clamp assembly riding in a U-shaped track shown in section view;

FIG. 4A is an exploded view of a segment of the FIG. 4 view, showing the removal chain to clamp mount;

THE PREFERRED EMBODIMENT OF THE INVENTION

Figure 1:
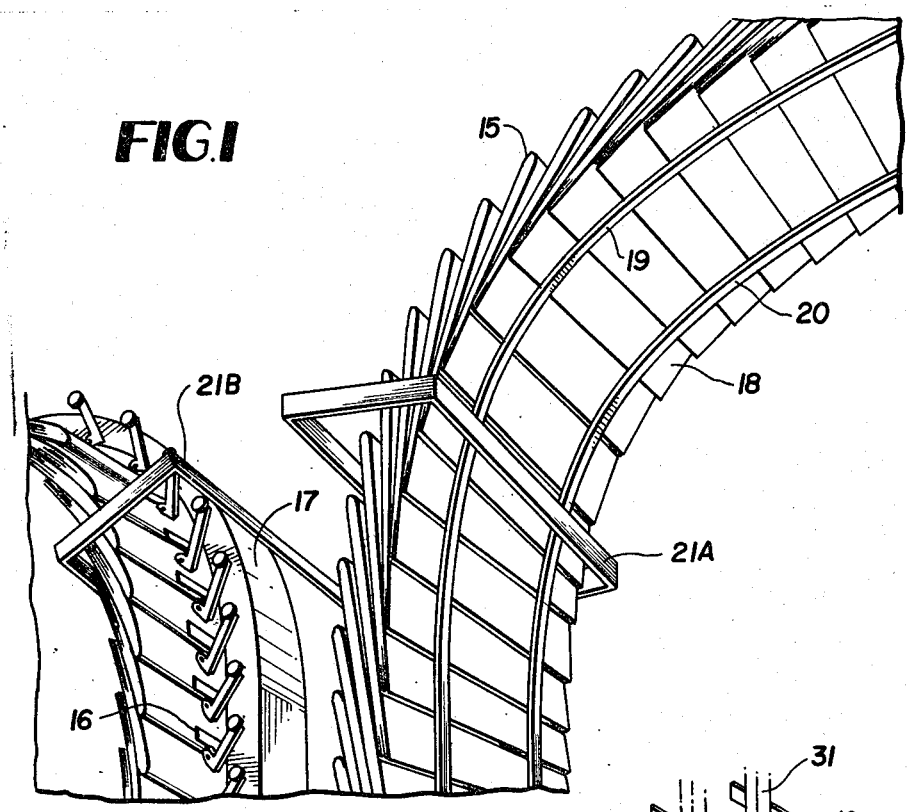
FIG. 1 is a segmental perspective view of a transport system conveying newspapers in accordance with the teachings of this invention.

As may be seen from FIG. 1 a plurality of paper sheet products 15, such as newspapers, inserts and the like, are individually grasped by a separate clamp 16 which rides along a track 17 over an appropriate path going downward on the left and upward on the right. The path may be curved, and it carries the products in a shingled array. To confine the product tails 18, a set of rails 19 and 20 (shown only in the upward travel path for simplicity sake) is mounted by surrounding brackets 21 to follow the track. Brackets 21A and 21B may, for example, be affixed to walls of a plant and the rail 17 is suitably supported by either floor, wall or ceiling supports to carry the paper sheet products on a desired travel path through a plant for processing at various work stations, etc.

Figure 2:
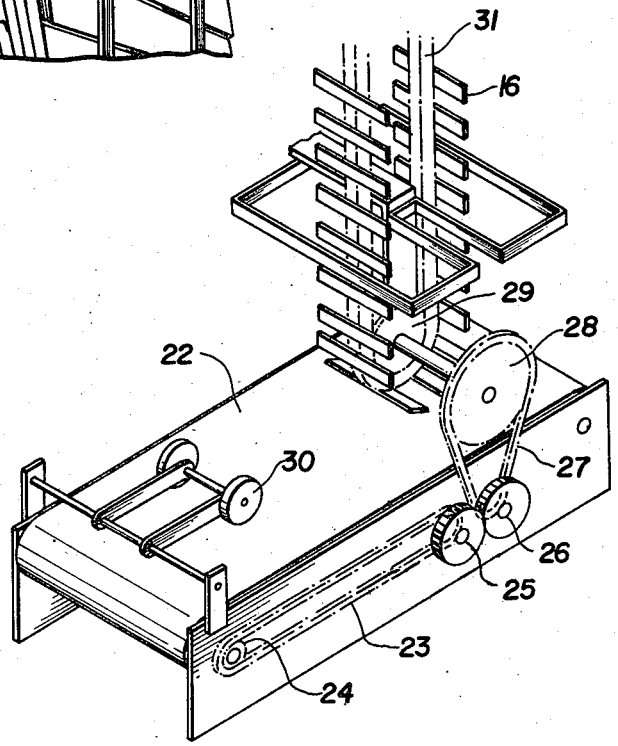
FIG. 2 is a perspective view of portion of a transport system afforded by this invention at which sequential paper sheet products may be transferred from a clamp transport assembly to a conveyor belt.

A transition station between transport by individual clamps and transport on a conveyor belt 22 is shown in FIG. 2. Thus, the conveyor belt is rotated by means of an electric motor drive means (not shown) at a desired transport speed affected by chain 23 and pulley 24. This speed is synchronized with that of the clamp type conveyor track assembly 16–17 as previously discussed by means of drive gears 25, 26, chain 27 and pulley 28. This provides drive power for the conveyor track 16–17 (FIG. 1) by means of chain sprocket 29 for moving clamps 16 with link chain 31 in a manner later shown. The products may be conveyed at the same or a different speed on the conveyor belt 22 as in the clamps 16. Thus products may be dropped from clamps 16 onto belt 22 in shingled or separate array in a manner later shown and transported to the left for discharge into an appropriate work process station such as a bundler, inserter, addresser, at synchronous speeds. The weighted rollers 30 assure positive feed off the left hand of the belt 22.

It is evident that by exactly spacing the paper products between clamps 16, and with drive speed control, the products can be synchronized with the processing speed of associated work stations at high speeds without rearrangement, loss of timing or disorientation along the travel path. The system typically operates on-line with high speed rotary presses to process newspapers at speeds of up to 60,000 pieces per hour, and transports papers over long distances and curved paths without danger of jiggling them out of exact position or of undesired changes of transport speed.

The clamps 16, track 17 and the drive chain 31 are seen in more detail in FIGS. 3, 3A, 4 and 4A. The clamp 16 comprises a fixed base panel 32 about which a pivoted clamping member 33 pivots by means of cam rollers 34, 35 at the extremities of pivot arms 36, 37 on either end region of the clamp assembly 16.

The clamp plate jaws 32, 33 are held in closed position by bias springs 38, 39 about the pivot shaft 40 to which pivot arms 36, 37 are affixed as well as the movable clamp jaw or plate 33.

The chain assembly 31 has roller shafts 41, 42 which removably mate into U-spring 43 apertures 44, 45 to provide a quick disconnect dismount for a clamp tractor assembly 16, so that repairs are quickly and effectively made in the time sensitive newspaper processing industry with little down time even in the event of a catastrophic failure of a clamp assembly. This can be done anywhere that the clamp assembly 16 is ont confined within track 17, such as near the bottom of the travel path in FIG. 2, or in a gap provided in the U-track 17.

The clamp tractor assembly 16 is provided with low friction roller bearing mounted tractor wheel sets with four inner track wheels 50 and two outer track wheels 51 which mate with the track as shown in FIG. 4. These outer track wheels 51 permit the clamp assembly to maneuver about curves in the track 17, later described. Preferably the wheel surfaces are of a low friction material not requiring lubrication such as a plastic material. It is evident therefore that the chain assembly 31 can transport a sequence of clamp assemblies 16 along a path defined by track 17 and associated pulleys (29, FIG. 1), etc. over a circulating path to precisely deliver paper products at a predetermined exact timing and separation distance at any position along the path.

Figure 5:
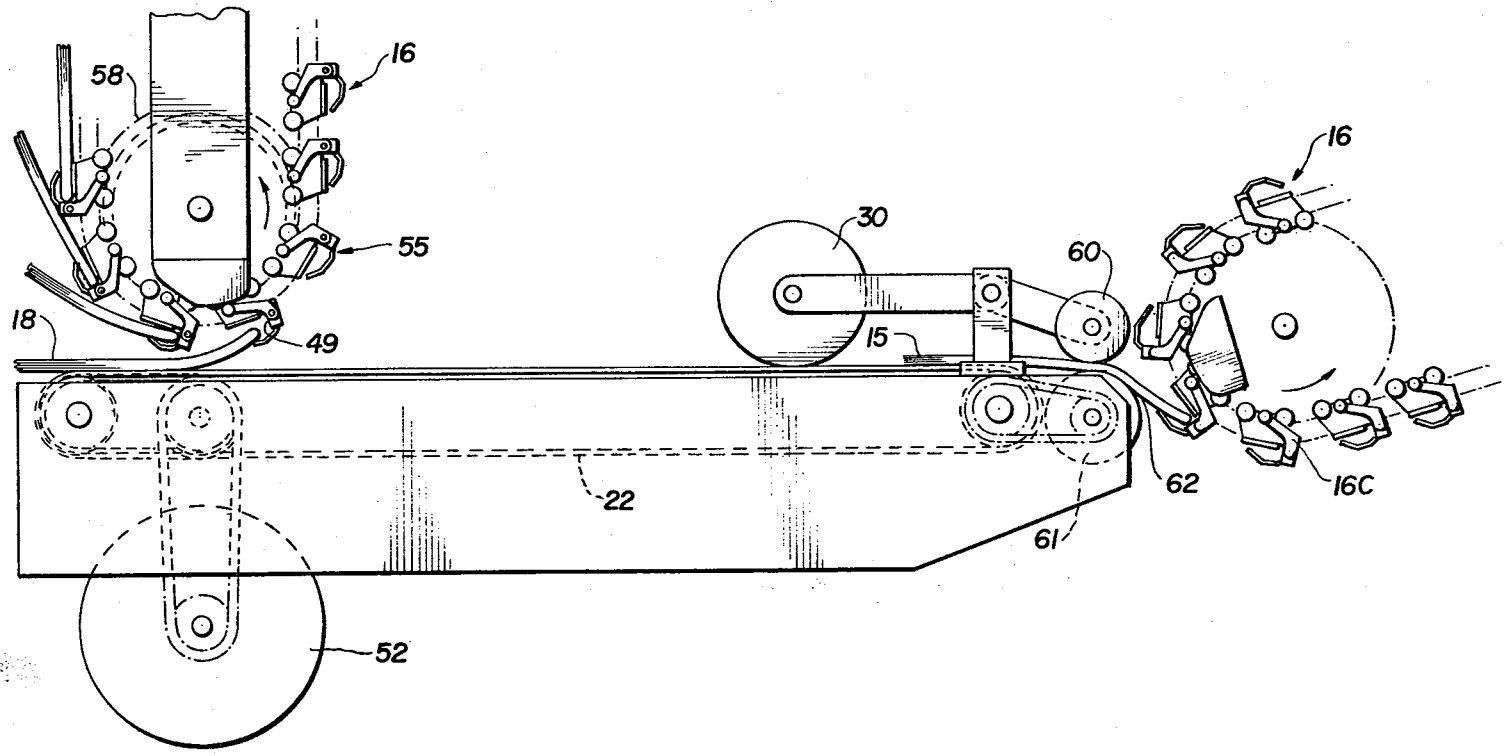
FIG. 5 is an elevation view of a conveyor belt transport segment between two clamp transport modules, showing the release and clamping operations.

There are, however, limitations on transit path lengths because of drive power, friction and like practical limitations. Thus as shown in FIG. 5, a modularized system is provided where clamp transport modules 55 and 56 are interconnected with a conveyor belt 22 of the nature shown in FIG. 2. This view illustrates with a single paper product to avoid complexity the discharge and pickup operations of the clamp conveyor modules. The drive motor 57 is connected as heretofore described to synchronously drive and to power conveyor module 55 and the belt 22.

Thus as the clamp assemblies 16 round bottom dead center of the transport track about the chain drive cogwheel 58, the clamps are opened by a camming arrangement not shown. The forward speed of the clamp 16 and its upward curvature past dead center permits the open jaw 33 to leave the fold end of paper product 15 and drop it on the conveyor belt 22 for conveyance thereby. Successive products 15 are shingled with the clamp 16 spacing and product lengths shown. The tail portion 18 of the paper product 15 drags friction wise on the belt surface (or previous paper product) which is at a slightly slower transport speed than the motion of clamps 16 around bottom dead center. The aforesaid rails 19, 20 of FIG. 1 are discontinued to let the tail 18 flop down upon conveyor belt 22.

Nip rollers 60, 61 then grasp the paper product 15 and force the folded end into the open clamp assembly as shown in module 56. The product 15 speed is greater than the lateral clamp 16 speed as indicated by bubble 62 to assure seating at the bottom of the clamp before the opening cam lets the clamp 16C close on and grasp the paper product 15C for further conveyance.

When the clamps 16 receive the paper in the clamp jaws, it is aligned in registration with the jaws in an exact position as defined by jaw stops 49 as seen in FIGS. 3 and 3A. This precise registration can thereby be maintained throughout the system.

Figure 6:
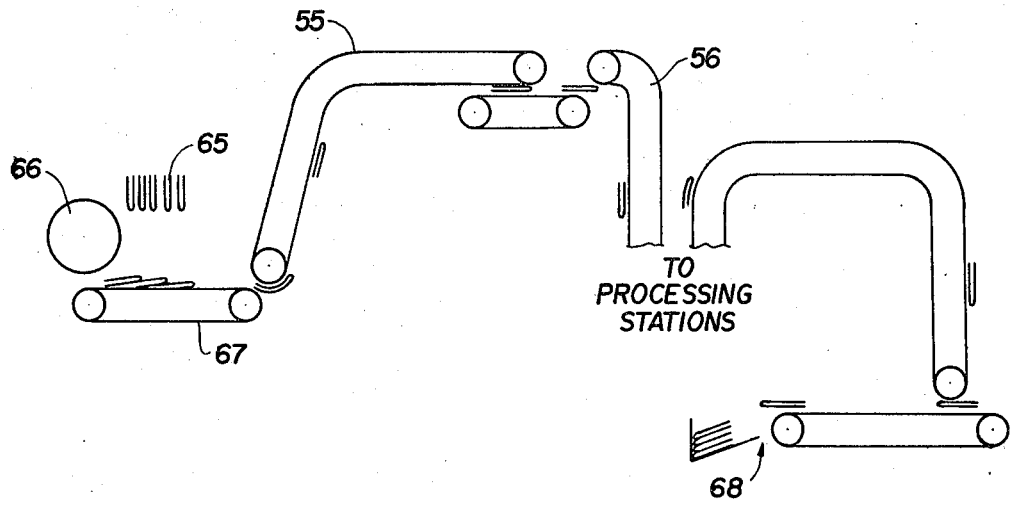
FIG. 6 is a schematic view of a transport system afforded by this invention.

With such intermediate transition conveyor belt units between modular circulating clamp transport units 55, 56, then an unlimited transport length about a plant is readily achieved. Thus, a typical system is shown schematically in FIG. 6, where stacked papers 65 are spaced by a spacer wheel arrangement 66 on conveyor belt 67 for entry into the system of modules 55, 56, etc. The path of the paper products is schematically shown, and goes to the various desirable processing stations not shown for precisely timed and synchronized inserting, addressing, labelling, counting and like operations before discharge into a bundler station 68, or the like.

Figure 7:
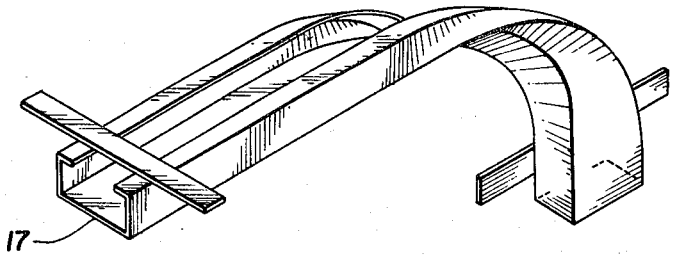
FIG. 7 is a perspective view of the transport track showing its ability to transport paper sheet products over a curved and twisted path.

One most desirable feature of this invention is plant and transport path space saving. Prior art transport systems did not have the capability of transport paths over limited plant space sites or over curved pathways. Typically if paper products are transported on conveyor belts, they cannot have curved paths and carry paper products at high speeds without jogging them out of position by centrifugal or centripetal force. Also the ability to go in vertical paths from floor to ceiling is not compatible with small space use or keeping paper products in exact spacing along the conveyor belts. The simplicity, space saving and path flexibility characteristics of the transport system afforded by this invention is illustrated by the U-shaped track characteristics shown in FIG. 7.

The schematically shown clamp 70 may for example be running parallel to a ceiling and the schematically shown clamp 71 be running down a side wall. The U-shaped track 17 then may be bent and/or twisted over rather sharp transport paths to provide for the first time universally located and oriented transport paths.

Figure 8:
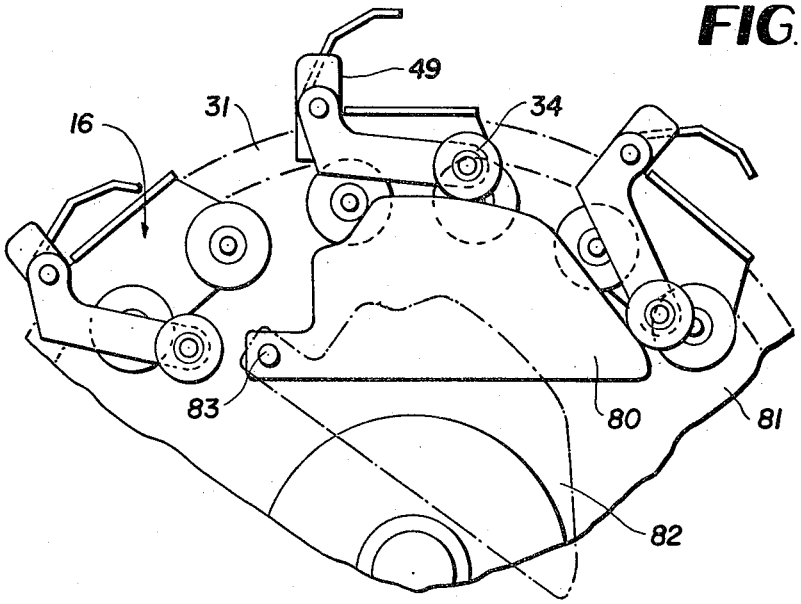
FIG. 8 shows in partial end view a typical programmable cam arrangement for selectively operating the clamps.

FIG. 8 illustrates the typical camming action for opening the normally closed clamp assemblies 16 by means of roller cam 34 riding upon a cam surface typified by member 80. Typically this cam is mounted adjacent a cogwheel 81 which engages chain 31 at a time the clamp assemblies 16 are out of the U-shaped track 17. Cam shape and placement is of course a variable choice at any particular installation. The phantom view 82 of cam 80 pivoted about shaft 83 illustrates the ability to program the clamps for releasing selected sets of paper products, such as those that need addressing to be diverted to a conveyor belt feeding an addressing machine for example. Clearly this or any other desired form of cam movement may be operated by pneumatic, mechanical or electrical solenoid means well known in the art.

It is therefore evident that this invention provides novel transport means, methods and systems improving the state of the art, and capable of precise timing and spacing of paper sheet products such as newspapers at very high on-line speeds with modern day high speed presses. Accordingly, those novel features believed descriptive of the nature and spirit of the invention are defined with particularity in the following claims.

INDUSTRIAL APPLICATION

Newspapers and like paper sheet products may be transported at press speeds up to 60,000 pieces per hour to on-line processing stations for inserting, stitching, counting, addressing, etc. at precisely timed and spaced intervals, thereby avoiding subsequent jogging or speed changing equipment.

I claim:

1. Simplified asynchronous to synchronous conversion apparatus for conveying paper sheet products with precision timing and spacing comprising in combination, means for passing a set of interconnected paper sheet product receiving selectively operable spaced gripping clamps each with a single pivoted spring biased grasping jaw cammable between open jaw and closed jaw positions for carrying products along a transit path between processing stations defined by a conveyance track, means including a plurality of stations located along the conveyance track for selectively opening and closing the clamp jaws as they pass the respective stations thereby to receive and discharge said products at said stations at a position substantially centered between the edges of the product leading edge, means for feeding the in sequence leading edge of moving paper sheet products individually into a registration stop position defined by adjacent opened clamps at a loading station to move in the direction of clamp movement along the track at a speed greater than the speed of the clamps along said path, and means for removing the products in precisely timed sequence from said clamps at a discharge station along the transit path by opening the clamp jaws carrying the paper sheet products.

2. Apparatus as defined in claim 1 further comprising means for interconnecting two circulating sets of clamps by an intermediate conveyor belt receiving the products released from the clamps of one set and introducing the products on the belt into the clamps of the other set.

3. Apparatus as defined in claim 1 further comprising means for driving the interconnected clamps of one set and the conveyor belt with common drive means.

4. Apparatus as defined in claim 1 further comprising means for removably interconnecting the clamps solely to a chain belt drive member passing along said conveyance track.

5. Apparatus as defined in claim 1 further comprising means for precisely spacing the stops in the adjacent clamps a predetermined distance apart to define the exact separation distance between products.

6. Apparatus as defined in claim 1 further comprising means for feeding the products into further processing equipment operable on a precise timing cycle, and means for controlling the conveyance speed of the clamps along the transit path synchronously with the further processing equipment to present products thereto for processing in conveyance with said timing cycle.

7. Apparatus as defined in claim 1 including confining means located along said track for retaining trailing edges of products clamped in said clamps in a confined transit path adjacent to said track.

* * * * *